United States Patent [19]

Stahlecker et al.

[11] Patent Number: 4,972,555

[45] Date of Patent: Nov. 27, 1990

[54] DRAFTING UNIT FOR SPINNING MACHINES

[75] Inventors: Fritz Stahlecker, Josef-Neidhart-Strasse 18, 7347 Bad Überkingen; Hans Stahlecker, Haldenstrasse 20, 7344 Süssen, both of Fed. Rep. of Germany

[73] Assignees: Fritz Stahlecker; Hans Stahlecker, both of Fed. Rep. of Germany

[21] Appl. No.: 492,055

[22] Filed: Mar. 12, 1990

Related U.S. Application Data

[63] Continuation-in-part of Ser. No. 379,646, Jul. 14, 1989.

[30] Foreign Application Priority Data

Mar. 16, 1989 [DE] Fed. Rep. of Germany ..... 3908584

[51] Int. Cl.[5] ..... D01H 5/70

[52] U.S. Cl. ..... 19/244

[58] Field of Search ..... 19/242–260

[56] References Cited

U.S. PATENT DOCUMENTS

| | | | |
|---|---|---|---|
| Re. 23,117 | 5/1949 | Carman | 19/244 |
| 2,741,801 | 4/1956 | Keyser | 19/244 |
| 4,680,833 | 7/1987 | Bahov et al. | 19/244 |

FOREIGN PATENT DOCUMENTS

| | | | |
|---|---|---|---|
| 908590 | 4/1954 | Fed. Rep. of Germany | 19/131 |
| 642162 | 7/1962 | Italy | 19/244 |

*Primary Examiner*—W. C. Reynolds
*Assistant Examiner*—John J. Calvert
*Attorney, Agent, or Firm*—Evenson, Wands, Edwards, Lenahan & McKeown

[57] ABSTRACT

In the case of a drafting unit for spinning machines, it is provided that the bottom roller and the pressure roller of a pair of delivery rollers have smaller diameters than the preceding pair of rollers, and that the pressure roller of the pair of delivery rollers is designed to have a smaller diameter than the pertaining bottom roller.

8 Claims, 1 Drawing Sheet

DRAFTING UNIT FOR SPINNING MACHINES

BACKGROUND AND SUMMARY OF THE INVENTION

This application is a Continuation-in-Part Application of pending U.S. patent application Ser. No. 07/379,646, filed July 14, 1989.

The invention relates to a drafting unit for spinning machines having several pairs of rollers which each contain a pressure roller provided with a covering and a bottom roller, and having an apron guide in a drafting zone in front of a pair of delivery rollers situated at the end of the drafting unit.

In the case of drafting units for spinning machines, it is customary to design the diameters of the pairs of rollers delimiting the individual drafting zones to be identical; i.e., the pair of rollers at the feeding side of the drafting unit have essentially the same diameters as the pair of rollers at the delivery side. The diameter of the pressure roller of the pair of delivery rollers, in this case, is customarily designed to be slightly larger than the diameter of the pertaining bottom roller so that the occurrence of periodical yarn defects is avoided. Since the covering of the pressure roller is reground from time to time, in order to maintain the desired spinning conditions, the diameter of the top roller is designed such that it is clearly larger than the diameter of the bottom roller so that the differences in diameter will also still exist after a regrinding.

According to the above-noted commonly assigned copending Application Ser. No. 07/379,646, filed July 14, 1989, based on German Patent Application (P 38 25 068.3), which is not a prior publication, it is provided that the diameters of the pressure roller and of the bottom roller of the pair of delivery rollers are smaller than the diameters of the preceding pairs of rollers. As a result, it is achieved that the apron guide existing in the last drafting zone can be extended closer to the nip line formed by the pair of delivery rollers so that the unguided length of the processed sliver is reduced. As a result, the quality of the drawing and therefore the quality of the later spun yarn can be improved.

An object of the invention is to improve the quality of the drawing work of a drafting unit of the initially mentioned type.

This object is achieved in that the bottom roller and the pressure roller of the pair of delivery rollers have smaller diameters than the preceding pair of rollers, and in that the pressure roller of the pair of delivery rollers is designed to have a smaller diameter than the pertaining bottom roller.

By means of this construction, it is provided, on the one hand, that the apron guide can extend close to the nip line of the pair of delivery rollers while, on the other hand, a regrinding of the pressure roller is possible without the risk that, during the regrinding, the pressure roller receives the same diameter as the pertaining bottom roller.

In a further development of the invention, it is provided that the covering of the pressure roller of the pair of delivery rollers is designed to have a thickness of more than 4 mm. As a rule, a thickness of the covering of at least 4 mm will be required in order to obtain the desired effect. In order to permit a regrinding, it is therefore expedient to design the thickness of the covering to be more than 4 mm.

In order to obtain a covering of a sufficient thickness despite the small diameter of the pressure roller of the pair of delivery rollers, it is provided in a further development of the invention that the pressure roller of the pair of delivery rollers is carried by means of a rolling bearing which, in axial direction, is arranged to be offset with respect to the covering. As a result, it is achieved that the bearing dimensions do not represent any restriction with respect to diameter of the pressure roller and/or with respect to the thickness of the covering.

Other objects, advantages and novel features of the present invention will become apparent from the following detailed description of the invention when considered in conjunction with the accompanying drawings.

DETAILED DESCRIPTION OF THE DRAWINGS

Figure 2:
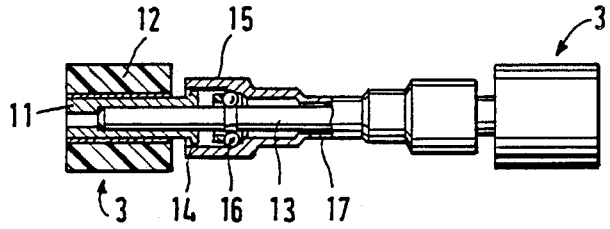
FIG. 2 is a partial view and a partial sectional view of a pressure roller twin for the pair of delivery rollers of the drafting unit according to FIG. 1.

The drafting unit according to the invention is shown only in the area of the last drafting zone which, in a known manner, is preceded by one or several additional drafting zones. A sliver which is to be drawn is shown by a dash-dotted line and moves in the direction of the arrow (A), and passes through the last drafting zone. The drafting zone is delimited by two pairs of rollers 1, 4, pair 1 of the rollers being the pair of delivery rollers at the end of the drafting unit. Pair 1 of the delivery rollers has a bottom roller 2 which is constructed as a cylinder extending through in the longitudinal direction of the machine and being driven at the machine end. A top roller 3, which is a component of a so-called pressure roller twin which will be described in detail by means of FIG. 2, is sssigned to this bottom roller 2.

The pair of rollers 4 preceding the pair of delivery rollers 1 contains a bottom roller 5 which is also constructed as a cylinder extending through in the longitudinal direction of the machine and being driven at the machine end. In addition, this pair of rollers 4 contains a pressure roller 6 which, in a manner not shown in detail, is also constructed as a so-called pressure roller twin.

In the drafting zone delimited by the pair of delivery rollers 1 and the preceding pair of rollers 4, an apron guide is arranged which is formed by a bottom apron 7 wound around the bottom roller 5 and of a top apron 8 wound around the pressure roller 6. Deflecting guides 9, which may be constructed in a known manner, for the bottom apron 7 and for the top apron 8 are provided in the area of the wedge-shaped gap 10 formed by the pair 1 of delivery rollers.

In order to be able to extend the deflecting points 9 and thus the bottom apron 7 and the top apron 8 as far as possible into the wedge-shaped gap 10 and as closely as possible to the nip line of the pair 1 of delivery rollers, the diameters ($d_U$) of the bottom roller 2 and ($d_O$) of the pressure roller are reduced with respect to the diameters ($D_U$ and $D_O$) of the preceding rollers 5, 6. As a result, it becomes possible to extend the bottom apron 7 and the top apron 8 more closely to the nip line of the pair of delivery rollers 1 so that the length is reduced along which the fiber material is unguided. This clearly improves the quality of the drawing result.

Figure 1:
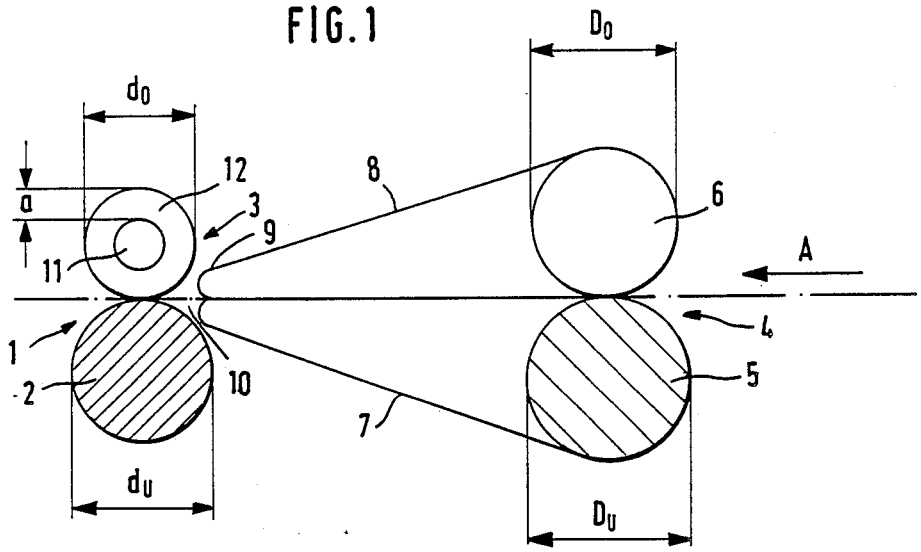
FIG. 1 is a schematic lateral view of a drafting unit in the area of a last drafting zone, constructed according to a preferred embodiment of the invention.

As a modification of the embodiment according to FIG. 1, the bottom roller 2 and/or the bottom roller 5 may naturally be constructed as short shaft pieces which extend only along one or two drafting units and which can each be driven and stopped separately.

The top roller 3 of the pair 1 of delivery rollers has a shaft body 11 to which a coating 12 is applied. In a known manner, the coating 12 consists of an elastic synthetic material, the hardness of which is such that it can be machined by grinding. In order not to impair the operation of the drafting unit, it is provided that the thickness (a) of the coating 12 is not below 4 mm. In order to further achieve that differences in diameter exist between the bottom roller 2 and the pressure roller 3, so that periodically occurring yarn defects are avoided, it is provided that the diameter ($d_O$) of the pressure roller 3 is smaller than the diameter ($d_U$) of the bottom roller 2. In the design, the difference in diameter amounts to approximately 1.5 mm. When a pressure roller 3 of this type is reground, there is not the risk that, by means of the regrinding, the difference in diameter is eliminated. In the case of this type of a regrinding of the pressure roller 3, there should be no falling-below a minimum thickness (a) of the covering 12 of 4 mm. From the start, the pressure roller 3 must therefore be designed such that a one-time or a repeated regrinding is possible without any falling-below the minimum thickness (a).

In order to be able to obtain a coating 12 with a thickness (a) that is as large as possible, despite the small diameter ($d_O$) of the top roller 3 of the pair 1 of delivery rollers, it is provided that the pressure roller 3 is carried by bearings 16 which are offset in axial direction with respect to the coating 12, as shown in FIG. 2 by means of a pressure roller twin which has two pressure rollers 3 of adjacent drafting units. The pressure roller 3 has a shaft 11 in the form of a sleeve which is pressed onto a shaft 13. This shaft 13 is disposed in a bearing sleeve 15 by means of two rolling bearings 16, a loading support, which is not shown, being applied to the center area of this bearing sleeve 15. The sleeve 15 has a widening in the area of the rolling bearing 16. The rolling bodies of this rolling bearing 16 move along in a groove directly at the shaft 13 and at the interior surface of the sleeve 15. The shaft 11, which is constructed as a sleeve, has a ring collar 14 which projects into the sleeve 15 and causes a sealing there.

In the embodiment according to FIG. 2, it is provided that the two pressure rollers 3 are constructed as so-called fixed rollers; i.e., as pressure rollers 3 which are fixedly arranged on a common rotating shaft 13. However, in a kinematic reversal, it is also contemplated to construct and dispose the pressure rollers 3 as so-called loose rollers which can then rotate independently of one another. For this purpose, it is possible to mount the coverings 12 on shaft ends which are disposed in a sleeve corresponding to sleeve 15 by means of rolling bearings, in which case, in order to avoid rocking motions, needle bearings and/or two bearing rows are provided.

Although the invention has been described and illustrated in detail, it is to be clearly understood that the same is by way of illustration and example, and is not to be taken by way of limitation. The spirit and scope of the present invention are to be limited only by the terms of the appended claims.

WHAT IS CLAIMED:

1. A drafting unit for spinning machines having several pairs of rollers which each contain a pressure roller provided with a covering and a bottom roller, and having an apron pair in a drafting zone preceding a pair of delivery rollers situated at the end of the drafting unit, wherein the bottom roller and the pressure roller of the pair of delivery rollers have smaller diameters than the preceding pair of rollers, and wherein the pressure roller of the pair of delivery rollers has a smaller diameter ($d_O$) than the pertaining bottom roller.

2. A drafting unit according to claim 1, wherein the diameter ($d_O$) of the pressure roller of the pair of delivery rollers is smaller by at least 1.5 mm than the diameter ($d_U$) of the pertaining bottom roller 2.

3. A drafting unit according to claim 1, wherein the covering of the pressure roller of the pair of delivery rollers is designed to have a thickness (a) of more than 4 mm.

4. A drafting unit according to claim 2, wherein the covering of the pressure roller of the pair of delivery rollers is designed to have a thickness (a) of more than 4 mm.

5. A drafting unit according to claim 1, wherein the pressure roller of the pair of delivery rollers is carried by means of a rolling bearing which is arranged to be offset in axial direction with respect to the covering.

6. A drafting unit according to claim 2, wherein the pressure roller of the pair of delivery rollers is carried by means of a rolling bearing which is arranged to be offset in axial direction with respect to the covering.

7. A drafting unit according to claim 3, wherein the pressure roller of the pair of delivery rollers is carried by means of a rolling bearing which is arranged to be offset in axial direction with respect to the covering.

8. A drafting unit according to claim 4, wherein the pressure roller of the pair of delivery rollers is carried by means of a rolling bearing which is arranged to be offset in axial direction with respect to the covering.

* * * * *